US007389548B2

(12) United States Patent
Chiang

(10) Patent No.: US 7,389,548 B2
(45) Date of Patent: Jun. 24, 2008

(54) SWIMMING GOGGLES

(76) Inventor: Herman Chiang, 11F, No. 634-9, Ching-Ping Rd., Chung-Ho City, Taipei Hsien (TW)

( * ) Notice: Subject to any disclaimer, the term of this patent is extended or adjusted under 35 U.S.C. 154(b) by 229 days.

(21) Appl. No.: 11/319,176

(22) Filed: Dec. 28, 2005

(65) Prior Publication Data

US 2007/0118978 A1 May 31, 2007

(30) Foreign Application Priority Data

Nov. 2, 2005 (TW) ..... 94218963 U

(51) Int. Cl.
*A61F 9/02* (2006.01)

(52) U.S. Cl. ..... 2/450

(58) Field of Classification Search ..... 2/426, 2/428, 440, 442, 445, 448, 450; 351/43
See application file for complete search history.

(56) References Cited

U.S. PATENT DOCUMENTS 6,349,419 B1 * 2/2002 Chiang ..... 2/428
6,405,384 B1 * 6/2002 Chiang ..... 2/428
7,020,904 B2 * 4/2006 Chiang ..... 2/442
7,146,654 B2 * 12/2006 Chiang ..... 2/428
7,257,848 B2 * 8/2007 Chiang ..... 2/448

* cited by examiner

*Primary Examiner*—Katherine Moran
(74) *Attorney, Agent, or Firm*—Troxell Law Office, PLLC

(57) ABSTRACT

Swimming goggles have a lens frame, lens received in the lens frame, and a strap adjusting means for adjusting a head strap. The lens frame includes a soft first frame enveloping a hard second frame. The second frame forms enhanced structure on a center of an upper portion thereof. The strap adjusting means includes buckles respectively assembled on both sides of the lens frame, and a head strap is wrapped through the buckles. The buckles have bases integrally formed with the second frame. When the swimming goggles are in use, a center of the upper portion of the second frame will not be bent or distorted, while both sides thereof are gradually distorted to fit to swimmer's foreheads, effectively guarding from water seepage.

15 Claims, 5 Drawing Sheets

SWIMMING GOGGLES

BACKGROUND OF THE INVENTION

1. Field of the Invention

The present invention relates to swimming goggles, and particularly to swimming goggles which has a mask-like protective pad and a soft first frame enveloping a hard second frame and which is formed enhanced structure on a center of an upper portion thereof and a strap adjusting means at both sides that be able to prevents the seepage of water when the swimming goggles are in use and enhance strength in assembly.

2. Related Art

Some swimming goggles with mask-like protective pads are shown in TW utility patent application Nos. 89213591, 89205145, 89215423, 89214699 and U.S. Pat. No. 6,276,794. Such swimming goggles have protective pads fitting with swimmer's foreheads and below eyeholes, that is, the swimmer's eyes are covered by the protective pads, thus the swimmer will not have a feeling of pressure on their eyes and prevent water seepage in use.

However, no matter the protective pad is assembled or integrated with lens frames, the protective pad disclosed in prior art are kept within a fixed range of span width. The width of swimmer's faces may be various sizes. For instance, when swimmer of narrow faces wear swimming goggles, the protective pad is bent inappropriately which results in the swimming goggles unable to fit closely to the swimmer's forehead or the vicinity of eyeholes. In other words, the swimming goggles cannot match different sizes of swimmer's faces and are unable to prevent water seepage in use.

Moreover, the swimming goggles with mask-like protective pads generally have strap adjusting means assembled on the lens frames which are made of soft material for adjusting length of head straps. The strap adjusting means includes a base and a cover which are made of hard material. A head straps of the strap adjusting means are wrapped along support shafts of the strap adjusting means on the bases and the covers, as disclosed in TW utility patent application Nos. 91220914, 92216640, 93202601, 93208473. Though, the hard bases and hard covers are assembled on the soft lens frames, which are weak as for integral structure.

SUMMARY OF THE INVENTION

Accordingly, an object of the present invention is to provide swimming goggles which have a soft first frame enveloping a hard second frame and which is formed enhanced structure on a center of an upper portion thereof, thereby matching for swimmer with narrow faces and effectively prevent water seepage in use.

Another object of the present invention is to provide swimming goggles which have a strap adjusting means assembled on a hard lens frame, the strap adjusting means have buckles which allow a head strap being wrapped therethrough for adjusting length of the head strap and which are retained to a hard lens frame for more strength in assembly.

The swimming goggles comprise a lens frame, lens received in the lens frame, and a strap adjusting means for adjusting a head strap. The lens frame includes a soft first frame enveloping a hard second frame. The first frame has a first surface, a second surface opposite to the first surface, and a third surface connecting the first surface and the second surface. A mask-like protective pad is disposed on the second surface. The second frame defines receiving grooves therein and forms enhanced structure on a center of an upper portion thereof. The lenses are respectively retained in the receiving grooves of the second frame. The strap adjusting means includes buckles respectively assembled on both sides of the lens frame, and a head strap extending through the buckles.

The enhanced structure of the second frame comprises an enhanced rib on a center of the second frame, and an enhanced wall extending from the enhanced rib toward opposing sides.

Each buckle includes a hard base integrally formed with the second frame, arms extending respectively from a lower edge and an upper edge of the base and defining shaft holes therein, and a support shaft and a securing shaft respectively received in the shaft holes.

DESCRIPTION OF THE PREFERRED EMBODIMENTS

Figure 1:
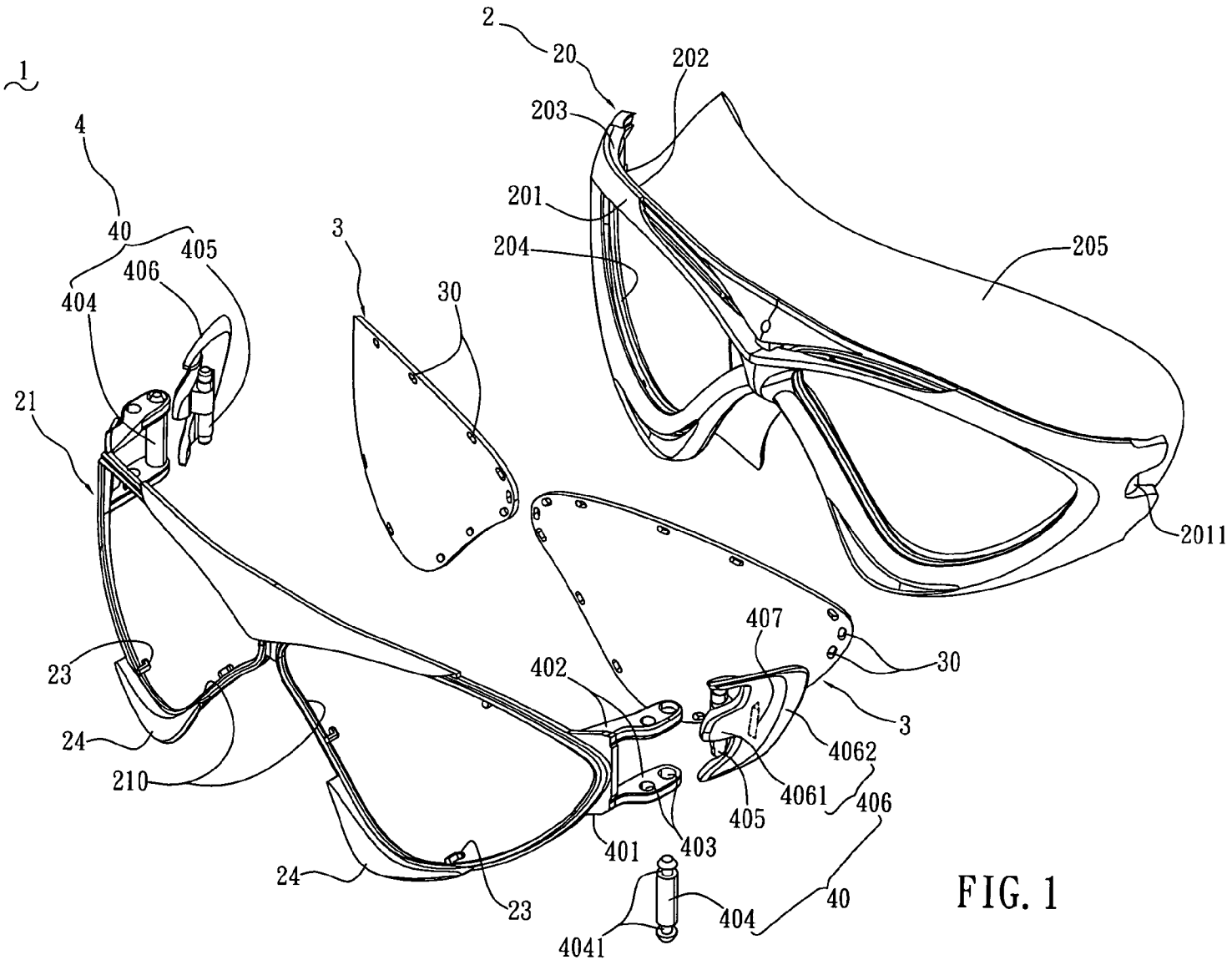
FIG. 1 is an exploded view of swimming goggles of the present invention.
Figure 6:
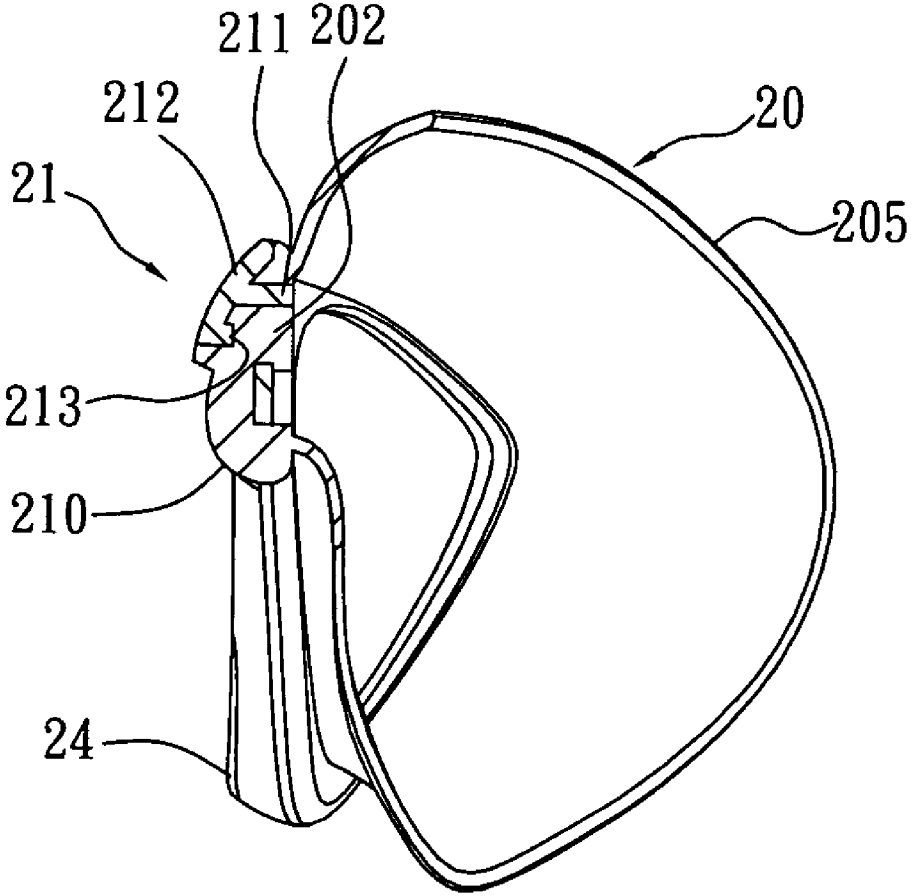
FIG. 6 is a cross-sectional view taken along the line 6-6 in FIG. 3.

With reference to FIG. 1, swimming goggles 1 in accordance with the present invention comprise a lens frame 2, lenses 3 and a strap adjusting means 4. The lens frame 2 has a first frame 20 made of soft material, and a second frame 21 made of hard material and enveloped by the first frame 20. The first frame 20 has a first surface 201, a second surface 202 opposite to the first surface 201, and a third surface 203 connecting the first surface 201 and the second surface 202. Compassing grooves 204 are defined between the first surface 201 and the second surface 202. Recesses 2011 are defined in the first surface 201 for providing distorted resiliency when compressed. A mask-like protective pad 205 is disposed on the second surface 202 for providing a well-fitting and comfortable contact with swimmer's foreheads and the vicinity of below eyeholes. The second frame 21 defines receiving grooves 210 corresponding to the compassing grooves 204. A joint portion 22 is formed between the receiving grooves 210 for connecting the receiving grooves 210. Fastening posts 23 are formed on inner edges of the receiving grooves 210 for preliminarily positioning the lenses 3. The second frame 21 has enhanced structure on a center of an upper portion thereof. Further referring to FIG. 6, the enhanced structure comprises an enhanced rib 211 on a center of the second frame 21, and an enhanced wall 212 extending from the enhanced rib 211 toward opposing sides and from which extends decreasingly along upper sides of the second frame 21 as extended parts; accordingly, the major part of the enhanced wall 212 is of the most strength, whereas the extended parts are of less strength. Thus, when the swimming goggles 1 are worn and pulled, the middle and upper portion of the second frame 21 will not be bent and distorted, while both sides of the second frame 21 are gradually distorted. An assembling post 213 is formed on the enhanced wall 212 and in the vicinity of the second surface 202. The enhanced rib 211 and the assembling post 213 facilitate the first surface 201 and the second surface 202 of the first frame 20 to provide reliable clasping force. Enhanced members 24 are formed below the second frame 21 for improving strength of the second frame 21. The enhanced members 24 are formed below substantially centers of the receiving grooves 210 of the second frame 21, respectively. Each enhanced member 24 has a width decreasing from middle toward both sides thereof.

The lenses 3 are respectively retained in the receiving grooves 210, and define a plurality of positioning holes 30 along outer rims thereof Some positioning holes 30 which correspond to the positioning posts 23 facilitate to position the lenses 3, while other positioning holes 30 provide retention force for integral molding process. The lenses 3 comprise two pieces of lens, each of which is received in an individual receiving groove 210.

Figure 4:
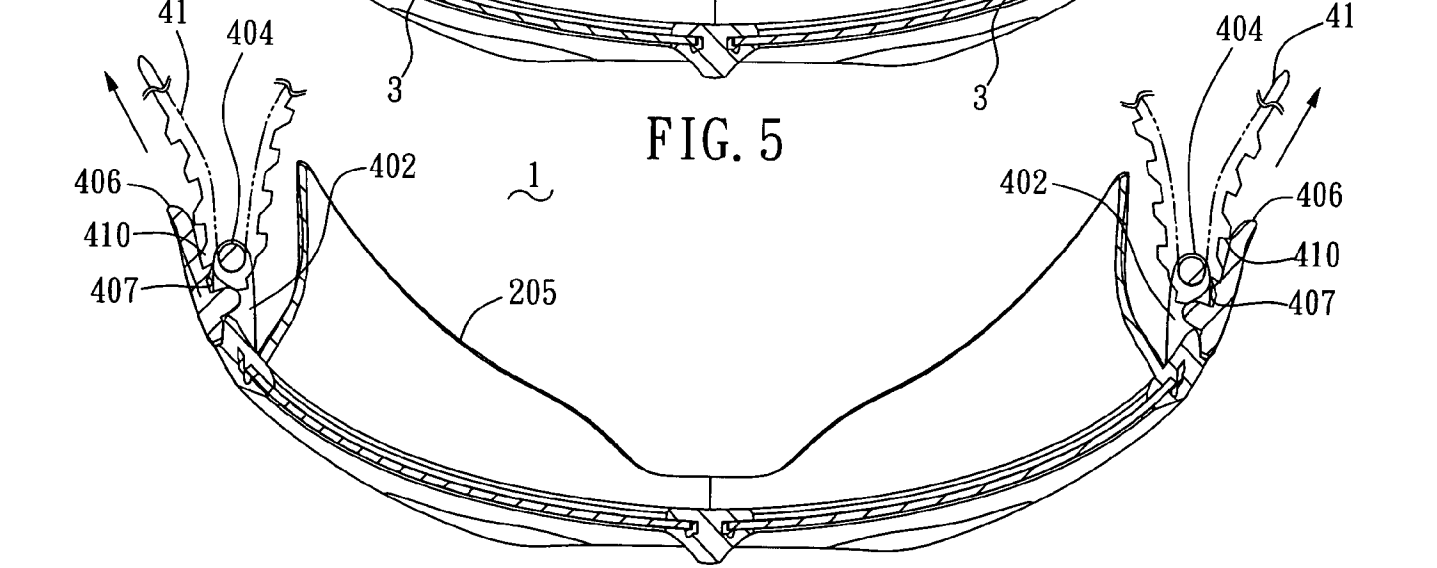
FIG. 4 is a cross-sectional view taken along the line 4-4 in FIG. 3.

The strap adjusting means 4 comprises buckles 40 and a head strap 41 wrapped through the buckles 40, as shown in FIG. 4. The buckles 40 are respectively assembled on both sides of the second frame 21. Each buckle 40 includes a base 401, arms 402, a support shaft 404 and a securing shaft 405. The base 401 is integrally formed with the second frame 21 and is made of hard material for firmly retaining the buckles 40 to the second frame 21. The arms 402 respectively extend rearwardly from a lower edge and an upper edge of the base 401. Shaft holes 403 are respectively defined in the arms 402. The support shaft 404 is mounted on the shaft holes 403 being relatively far away from the base 401. The support shaft 404 forms necks 4041 at two ends thereof, thereby the support shaft 404 can be firmly engaged with the shaft holes 403. The securing shaft 405 is mounted on the shaft holes 403 being relatively close to the base 401. A pressing plate 406 is integrally formed on the securing shaft 405 and levers along the securing shaft 405 and corresponds to the first surface 201 of the first frame 20. The pressing plate 406 has a first end 4061 biasing against the recess 2011 of the first surface 201. When the pressing plate 406 is pressed toward the first surface 201, the recess 2011 therefore is distorted and produces resilience force in return to drive the pressing plate 406 back. The pressing plate 406 has a second end 4062 for manipulating. At least a first stop member 407 has a shape of right-triangle cross-section and is formed on a bottom of the second end 4062 for abutting second stop members 410 (described below) of the head strap 41.

Also referring to FIG. 4, the head strap 41 forms second stop members 410 with right-triangle ladderlike cross-section and spaced the same distance apart from each other for engaging the first stop member 407 in a single direction. In the case of a second stop member 410 engaging with the first stop member 407, the head strap is allowed to move only in a single direction of tightening instead of a direction of loosening.

Figure 2:
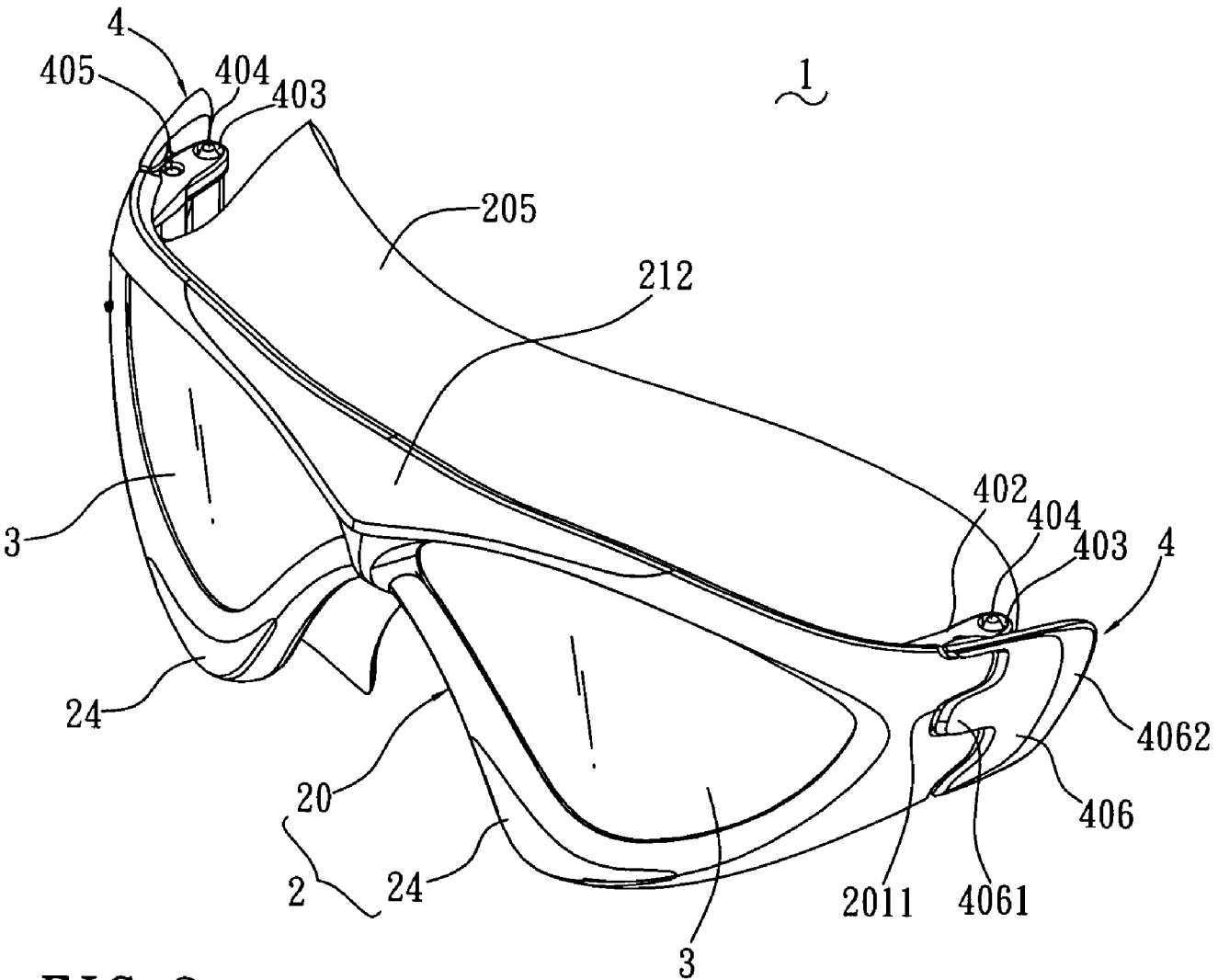
FIG. 2 is an assembled view of the swimming goggles of FIG. 1.
Figure 3:
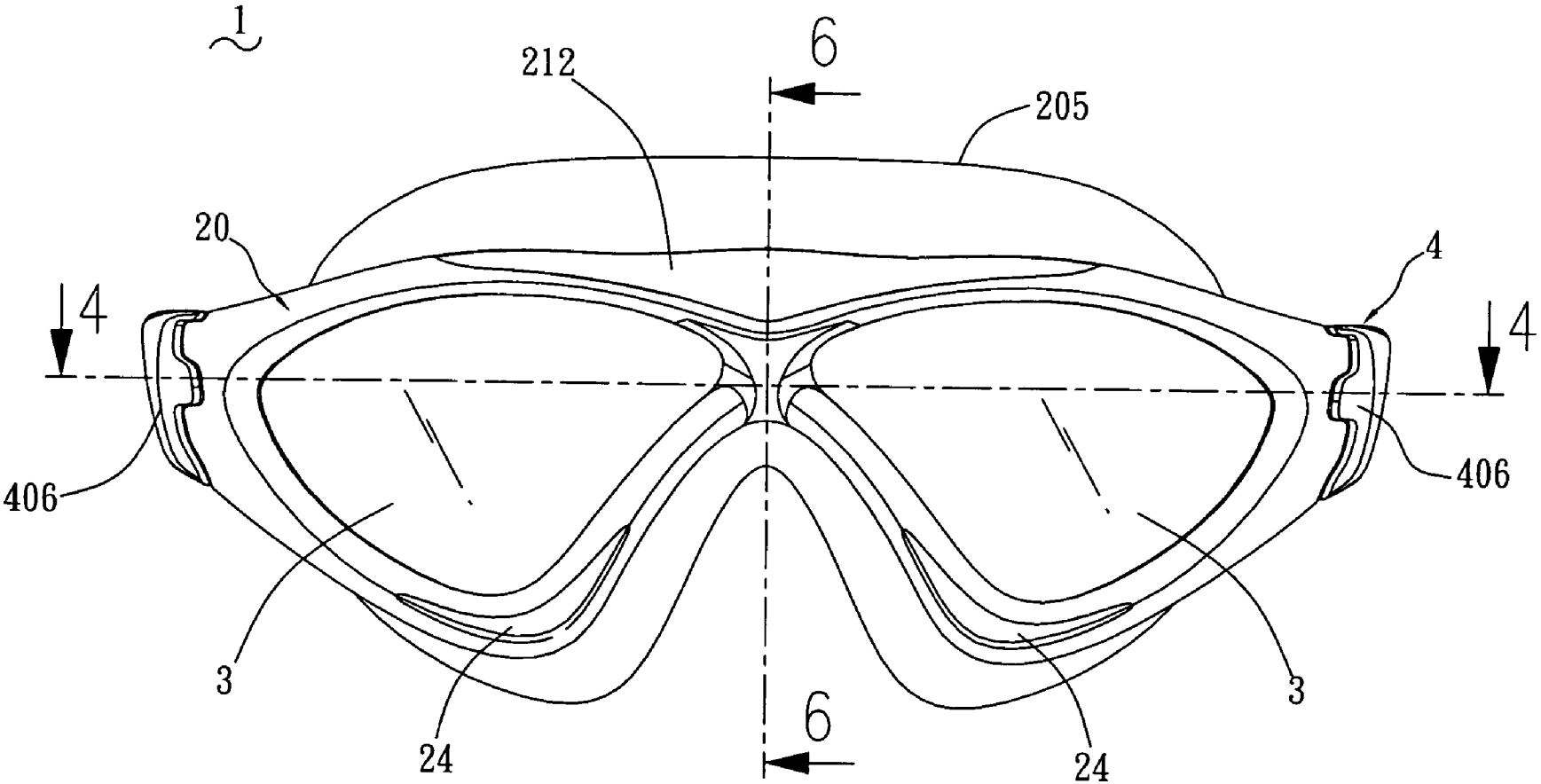
FIG. 3 is a front view of the swimming goggles of FIG. 2.

During assembly, some positioning holes 30 of the lenses 3 are assembled on the positioning posts 23 to preliminarily position the lenses 3. Upon integral molding technology, the second surface 202 encompasses the positioning posts 23 and the remained positioning holes 30, whereby the lenses 3 are integrated with the first frame 20. The first surface 201 and the second surface 202 of the first frame 20 encompass the second frame 21, the enhanced rib 211, the joint portion 22, the bases 401 of the buckles 40 and parts of the arms 402. The enhanced walls 212, the enhanced members 24 and the shaft holes 403 of the arms 402 are exposed beyond exterior, as shown in FIGS. 2 and 3.

Figure 5:
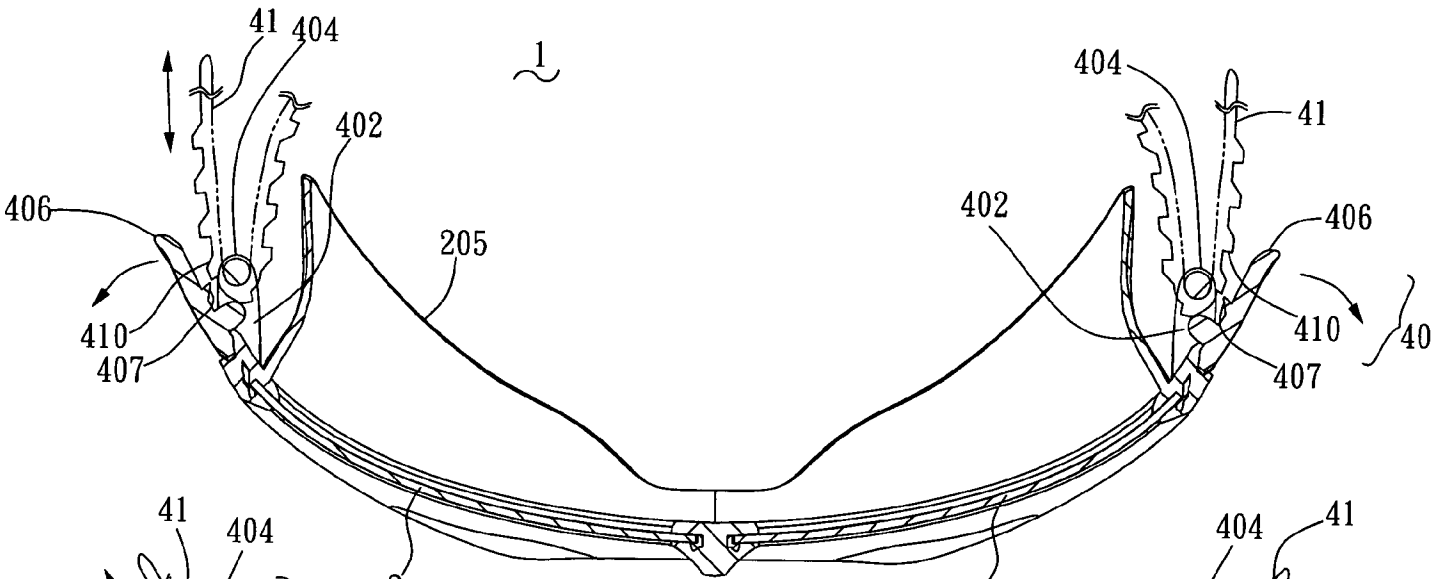
FIG. 5 schematically shows a head strap of the swimming goggles being adjusted.

Further referring to FIG. 4, two ends of the head strap 41 respectively wrapped through arms 402 and bypass the support shafts 404. The second stop members 410 of the head strap 41 mesh with the first stop member 407 in a single direction. The head strap 41 is allowed to move only in a single direction toward tightening, as the arrow shown in FIG. 4, instead of moving toward the reverse direction of loosening, because the first stop member 407 and the second stop members 410 engage with each other and therefore stop mutually. Referring to FIG. 5, when the pressing plates 406 are pushed upward, as the arrow shown in FIG. 5, the first stop member 407 and the second stop members 410 disengage from each other, so as to be able to adjust length of the head strap 41.

The enhanced structure of the second frame 21 ensures strength thereof decreasing from a middle thereof toward opposite sides. Consequently, when the swimming goggles 1 are in use, the center of the upper portion of the second frame 21 will not be bent or distorted, while both sides thereof are gradually distorted to fit to swimmer's foreheads, effectively guarding from water seepage.

It is understood that the invention may be embodied in other forms without departing from the spirit thereof Thus, the present examples and embodiments are to be considered in all respects as illustrative and not restrictive, and the invention is not to be limited to the details given herein.

I claim:

1. Swimming goggles comprising:

a lens frame including a soft first frame enveloping a hard second frame, the first frame having a first surface, a second surface opposite to the first surface, and a third surface connecting the first surface and the second surface, compassing grooves being defined between the first surface and the second surface, a mask-like protective pad being disposed on the second surface, the second frame defining receiving grooves corresponding to the compassing grooves of the first frame, and forming enhanced structure on a center of an upper portion thereof;

lenses retained in the receiving grooves of the second frame; and a strap adjusting means including buckles respectively assembled on both sides of the lens frame, and a head strap wrapped through the buckles, wherein a joint portion is formed between the receiving grooves of the second frame, wherein lenses comprise two pieces of lens, each of which is received in an individual receiving groove.

wherein enhanced members are formed on lower sides of the second frame, and each enhanced member has width being decreased from middle thereof along the lower sides of the second frame.

2. The swimming goggles as claimed in claim 1, wherein fastening posts are formed respectively on inner edges of the receiving grooves for preliminarily positioning the lenses, wherein lenses define a plurality of positioning holes along outer rims thereof, and wherein some positioning holes correspond to the positioning posts and facilitate to position the lenses, while other positioning holes provide retention force for integral molding process.

3. The swimming goggles as claimed in claim 1, wherein the buckles are assembled on both sides of the second frame, and each buckle includes a base integrally formed with the second frame, arms extending respectively from a lower edge and an upper edge of the base and defining shaft holes therein, and a support shaft and a securing shaft respectively mounted on the shaft holes.

4. The swimming goggles as claimed in claim 3, wherein the support shaft forms necks at two ends thereof for respectively engaging with the shaft holes and fixedly retaining the arms.

5. The swimming goggles as claimed in claim 3, wherein the securing shaft is pivotably mounted on the shaft holes being relatively close to the base, a pressing plate is integrally formed on the securing shaft and corresponding to the first surface of the first frame and levering along the securing shaft, and wherein the pressing plate has a first end biasing against the first surface, and a second end for manipulating, at least a first stop member being formed on the second end.

6. The swimming goggles as claimed in claim 5, wherein the head strap forms second stop members spaced the same distance apart from each other for engaging the first stop member in direction; thereby the head strap is allowed to move only in a single direction of tightening instead of a direction of loosening.

7. The swimming goggles as claimed in claim 5, wherein the first stop member has a triangular cross-section.

8. The swimming goggles as claimed in claim 5, wherein recesses are defined on the first surface for the pressing plate being retained thereon and said pressing plate is repositionable by force exerted on the pressing plate as the pressing plate being pressed.

9. The swimming goggles as claimed in claim 5, wherein the first surface and the second surface of the first frame encompass the second frame, the enhanced rib, the joint portion, the bases of the buckles and parts of the arms, while the enhanced walls, the enhanced members and the shaft holes of the arms are exposed.

10. Swimming goggles comprising:

a lens frame including a soft first frame enveloping a hard second frame, the first frame having a first surface, a second surface opposite to the first surface, and a third surface connecting the first surface and the second surface. compassing grooves being defined between the first surface and the second surface, a mask-like protective pad being disposed on the second surface, the second frame defining receiving grooves corresponding to the compassing grooves of the first frame, and forming enhanced structure on a center of an upper portion thereof;

lenses retained in the receiving grooves of the second frame; and a strap adjusting means including buckles respectively assembled on both sides of the lens frame, and a head strap wrapped through the buckles, wherein the enhanced structure of the second frame comprises an enhanced rib on a center of the second frame, and an enhanced wall forming from the enhanced rib and extending toward opposing sides thereof.

11. The swimming goggles as claimed in claim 10, wherein a middle of the enhanced wall being formed as a major part thereof and extending along upper sides of the second frame such that the wall decreases in thickness; accordingly, the major part of the enhanced wall is of the most strength, whereby the middle portion of the second frame will bend and distort, when the swimming goggles are worn and pulled, while both extended parts thereof are gradually distorted.

12. The swimming goggles as claimed in claim 11, wherein an assembling post is formed on the enhanced wall and in the vicinity of the second surface for facilitating the second surface of the first frame to provide reliable clasping force.

13. Swimming goggles comprising:

a lens frame including a soft first frame enveloping a hard second frame, the first frame having a first surface, a second surface opposite to the first surface, and a third surface connecting the first surface and the second surface, wherein compassing grooves being defined between the first surface and the second surface, a mask-like protective pad being disposed on the second surface, the second frame defining receiving grooves thereon corresponding to the compassing grooves of the first frame for receiving lenses; and a strap adjusting means including buckles respectively assembled on both sides of the lens frame, and a head strap wrapped through the buckles, each buckle including:

a base integrally formed with the second frame and made of hard material, arms extending respectively from a lower edge and an upper edge of the base, and defining shaft holes thereon, a support shaft received in the shaft holes being relatively far away from the base, and forming necks at two ends thereof for respectively engaging with the shaft holes, and a securing shaft pivotably mounted on the shaft holes being relatively close to the base, wherein a pressing pivots on the securing shaft, the pressing plate having a first end biasing against the first surface, and a second end for manipulating, at least a first stop member being formed on the second end;

the head strap forming second stop members for engaging the first stop member in a single direction, the head strap is allowed to move only in a single direction of tightening instead of a direction of loosening.

14. The swimming goggles as claimed in claim 13, wherein the first stop member has a triangular cross-section.

15. The swimming goggles as claimed in claim 13, wherein recesses are defined on the first surface for the pressing plate being retained thereon and said pressing plate is repositionable by force exerted on the pressing plate.

* * * * *